United States Patent [19]

Ferguson

[11] 4,429,857

[45] Feb. 7, 1984

[54] APPARATUS FOR INTEGRALLY REMOVING A TRACK PLATE AND SPIKES

[76] Inventor: W. Gardner Ferguson, 2518 Broad Ave., Altoona, Pa. 16601

[21] Appl. No.: 461,002

[22] Filed: Jan. 26, 1983

[51] Int. Cl.[3] ..... B25C 11/00

[52] U.S. Cl. ..... 254/18; 29/252

[58] Field of Search ..... 254/18, 30; 29/261, 29/252, 256; 294/104; 92/75

[56] References Cited

U.S. PATENT DOCUMENTS

| | | | |
|---|---|---|---|
| 2,483,239 | 9/1949 | Sharpe | 92/75 |
| 2,575,412 | 11/1951 | Fechter | 29/256 |
| 2,607,110 | 8/1952 | Labounsky | 29/256 |
| 2,661,063 | 12/1953 | Owens | 254/30 |
| 2,945,674 | 7/1960 | Hursh | 254/18 |
| 3,322,456 | 5/1967 | Strakhal et al. | 294/104 |
| 3,883,118 | 5/1975 | Miller | 254/18 |

*Primary Examiner*—Robert C. Watson

*Attorney, Agent, or Firm*—Shlesinger, Arkwright, Garvey & Fado

[57] ABSTRACT

An apparatus for integrally removing a track plate and spike and including a tie, comprising an elongated ground-supported frame; crowbar means movably connected to said frame, a portion of said crowbar means being adapted to be positioned between a track plate and a tie for displacing said plate and spikes from the tie; means for positioning said portion of said crowbar means between said track plate on said tie; and, power means connected to said frame from lifting said frame and crowbar means to raise said plate from said tie and extract said spikes from said tie thereby is disclosed.

13 Claims, 8 Drawing Figures

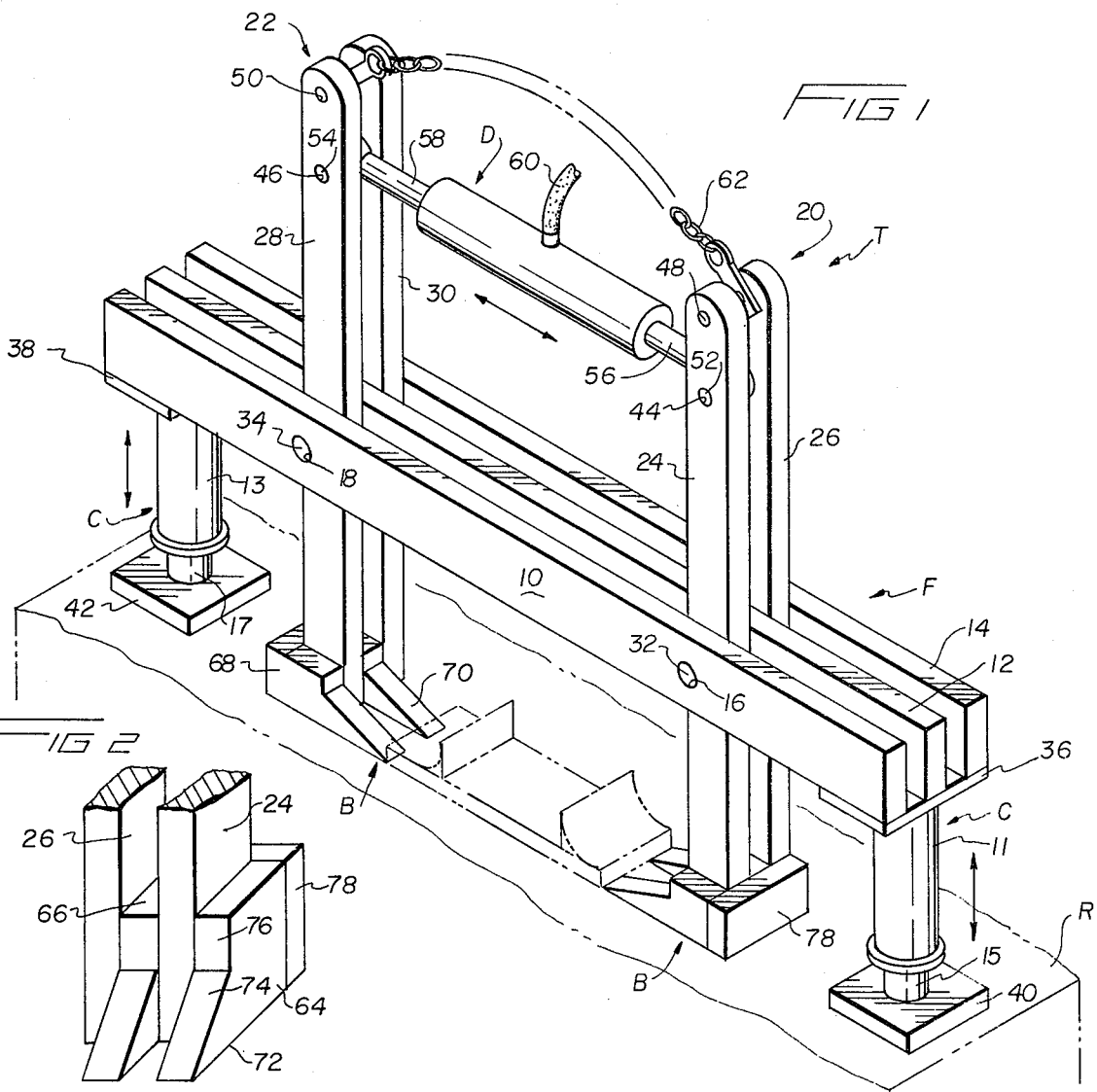
FIG 1
FIG 2
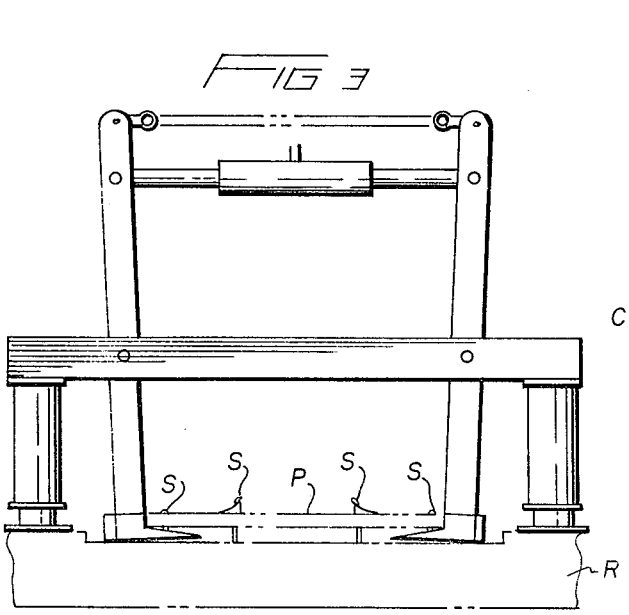
FIG 3
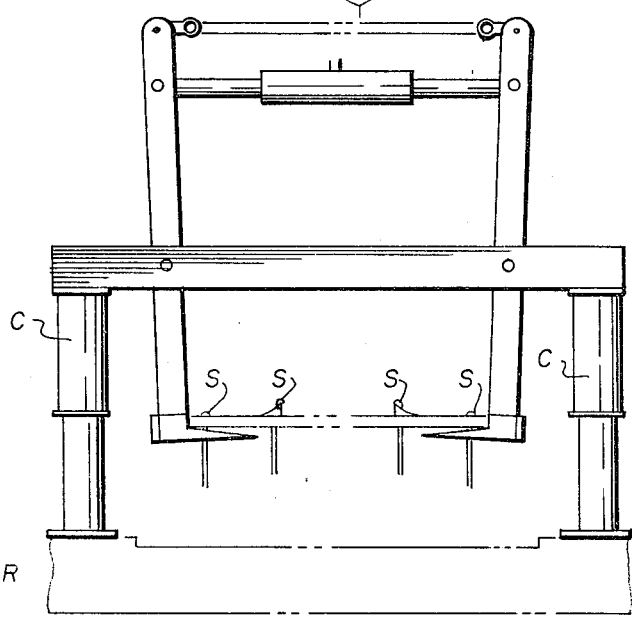
FIG 4

APPARATUS FOR INTEGRALLY REMOVING A TRACK PLATE AND SPIKES

BACKGROUND OF THE INVENTION

Railroad track, generally, is spiked to a rectangular metal holding plate or track plate which is likewise spiked to a solid, usually, rectangular wooden tie. It may be necessary, for a various number of reasons, to remove the track plate and spikes from the tie. Frequently, removal of the plate and spikes is accomplished because the section of track is being replaced or because the ties are being sold and salvaged.

Heretofore it has been necessary to remove the spikes individually prior to removing the track plate. Generally, at least four spikes, and sometimes as many as eight spikes, are used to fasten the rail and the track plate to the tie. Removal of the spikes individually is an arduous task which is also very time consuming. The spikes are usually removed with the aid of a long heavy crow bar. Unfortunately, due to the weight of the crow bar and the amount of energy expended in removing an individual spike a workman is not able to use the crow bar for a very long period of time.

Various machines have been devised to individually remove the spikes. These spike pullers include: Hursh, U.S. Pat. No. 2,945,674; Jimerson, U.S. Pat. No. 1,771,712; and, Janzer, U.S. Pat. No. 2,819,872. All of these machines suffer from the basic drawback that they operate individually on a spike and not on the entire plate and spikes unit.

Consequently, a machine for integrally lifting a bed plate from the tie while simultaneously removing the spikes is desirable. Such an apparatus has the advantage that only one operation is necessary to remove all of the spikes and the track plate as opposed to previous machines which required multiple time consuming operations.

OBJECTS OF THE INVENTION

A primary object of the disclosed invention is to provide an apparatus for integrally removing a track plate and spikes from a railroad tie.

An additional object of the disclosed invention is to provide an apparatus which is capable of removing the track plate and spikes in a single operation.

A further object of the disclosed invention is to provide an apparatus which is relatively lightweight and easy to use.

Yet another object of the disclosed invention is to provide an apparatus which is hydraulicly powered.

Yet still a further object of the disclosed invention is to provide an apparatus which employs a number of opposed crow bars which are positionable between the track plate and the railroad tie for separating the track plate from the tie.

Yet a further object of the disclosed invention is to provide an apparatus which is portable.

Still another object of the disclosed invention is to provide a supported crow bar carriage assembly to prevent the carriage members from becoming bent and therefore not sliding properly.

These and other objects and advantages of the disclosed invention will be apparent from the following description and claims.

DESCRIPTION OF THE DRAWINGS

In the accompanying drawings, which illustrate by way of example various embodiments of this invention:

FIG. 1 is a fragmentary perspective view of an integral track plate and spike remover;

FIG. 2 is a fragmentary perspective view of the crow bars and arms of FIG. 1;

FIG. 3 is a side elevational view of the apparatus of FIG. 1 and disclosing the track plate and spikes after positioning of the crow bars;

FIG. 4 is another side elevational view of the apparatus of FIG. 1 and disclosing the track plate and spikes after having been removed from the tie;

DESCRIPTION OF THE INVENTION

Figure 5:
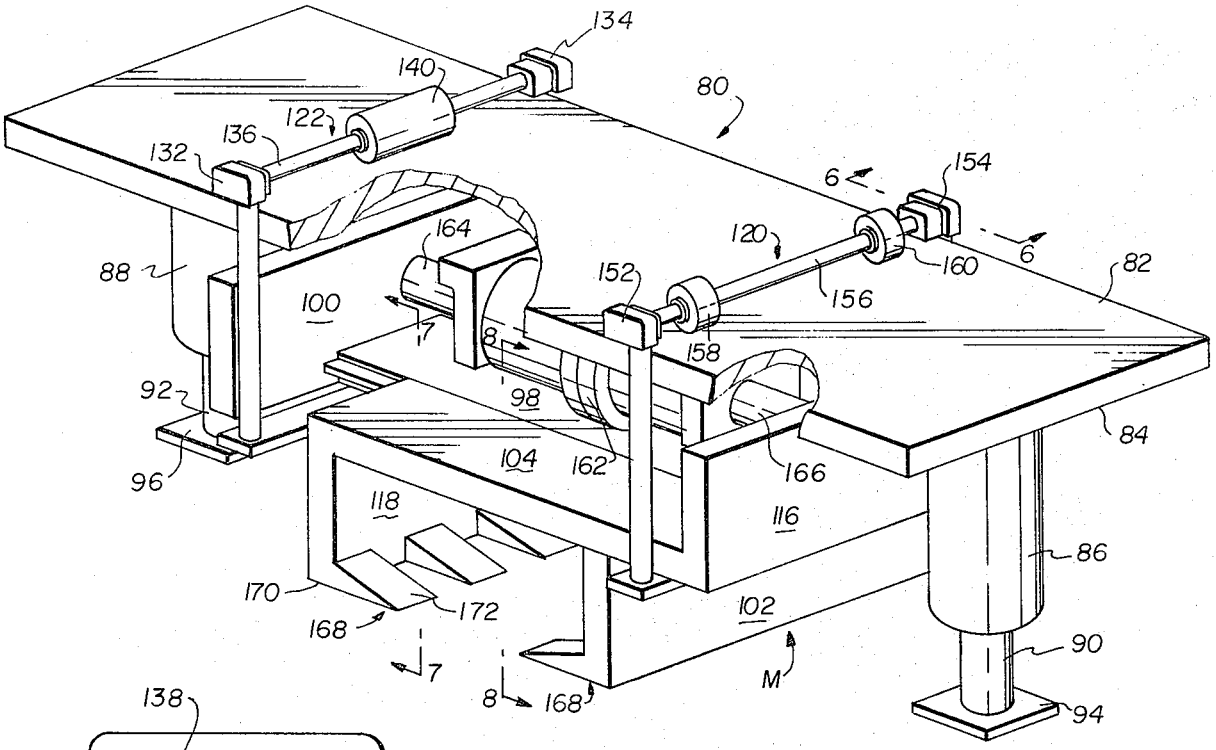
FIG. 5 is a perspective view with portions broken away of another embodiment of the apparatus.

Referring now to FIG. 1, the track plate and spike remover assembly is comprised generally of a frame F, frame lifting assembly C and a crowbar assembly B.

As best shown in FIG. 1, frame F is comprised of three like elongated members of rectangular cross-section designated 10, 12 and 14 disposed in a longitudinal plane in spaced parallel relationship. Members 10, 12 and 14 are provided with aligned openings 16 and 18 which are spaced from each other and from the ends of the members 10, 12 and 14.

Members 10, 12 and 14 have mounting plates or brackets 36 and 38 fixedly secured to the lower side of members 10, 12 and 14. Cylinders 11 and 13 are secured to plates 36 and 38 and pistons 15 and 17 to plates 40 and, respectively 42. Lifting cylinders 11 and 13, including lifting pistons 15 and 17, have a longitudinal axis which is substantially parallel to the axis of members 24, 26, 28 and 30 and substantially transverse to the central longitudinal axis of member 12. Pistons 15 and 17 are mounted to lower support plates 40 and 42 for the allowing track plate and spike remover assembly to be placed longitudinally on a railroad tie R.

Crowbar assembly B includes a pair of opposed arms 20 and 22 normally pivotably mounted to frame F. Arms 20 and 22 each are comprised of a two piece set of transversely extending substantially rectangular members 24, 26, 28 and 30 disposed in spaced parallel relationship. Members 24 and 26 have apertures (not shown) for cooperating with aperture 16 and for receipt of pin or fastening mechanism 32 for pivotably securing members 24 and 26 to frame F. Longitudinal member 12 is positioned between members 24 and 26 and likewise is adapted for receiving pin 32. Similarly, members 28 and 30 are spaced from members 24 and 26 and are positioned on either side of member 12 and have cooperating apertures (not shown) for cooperating with aperture 18 and for receiving pin 34 so that members 28 and 30 are pivotably mounted to frame F. Members 24, 26, 28 and 30 have extending upper and lower ends.

Members 24, 26, 28 and 30 are positioned on pins 32 and 34 such that the lower ends of members 24, 26, 28 and 30 are substantially aligned with and parallel with the lower surfaces of support plates 40 and 42. At the upper ends of members 24, 26, 28 and 30 are cooperating apertures 44 and 46. Another set of cooperating apertures 48 and 50 are positioned and spaced above apertures 44 and 46. A conventional double action hydraulic cylinder D, having an axis of operation parallel to and positioned above the central longitudinal axis of the member 12 is positioned in apertures 44 and 46 and pinned there by pins 52 and 54. The double action hydraulic cylinder D is one which has co-axial opposed pistons which are capable of operating simultaneously such that both pistons 56 and 58 move outwardly or inwardly in tandem. The double action cylinder D is operated by means of a hydraulic unit (not shown), of which one hydraulic line 60 is shown. Suitable double action cylinders may be purchased from OTC Corporation and from Parker Hannefin.

A chain 62 or other lifting mechanism may be secured in appertures 48 and 50 so that the track plate and spike remover assembly may be moved from one railroad tie R to another.

As best shown in FIG. 2, arm 20 is comprised of a two-piece set, of which spaced parallel rectangular members 24 and 26 are shown. Crowbars 64 and 66 are positioned on members 24 and 26 at their lower end. Likewise crowbars 68 and 70 are positioned on the lower end of members 28 and 30. Crowbar assembly B is positioned such that the crowbars 64 and 66 of arm 20 are opposed by the crowbars 68 and 70 of arm 22.

Crowbar 64, which is typical of crowbars 64, 66, 68 and 70 has a lower railroad tie contacting portion 72 and an angled track plate contacting portion 74. Portion 74 extends upwardly from portion 72 and an apex results therefrom. Surface 76 is substantially parallel to members 24 and 26 and transverse to surface 72 and acts to prevent the track plate P from rising further on surface 74 and therefore secures track plate P therein. A back member 78 extends along the back portion of crowbars 64 and 66 and is securely fastened to crowbars 64 and 66 and to the back portion of members 24 and 26 to add strength to the crowbars. Although only crowbar 64 has been fully described, it is to be appreciated that crowbars 66, 68 and 70 are substantially the same as crowbar 64 and have the same type of surfaces for contacting the railroad tie, contacting the track plate P and holding track plate P.

In the embodiment shown in FIGS. 5 through 8, a rail plate and spike extractor assembly has a ground supported frame 80 which is rectangular in shape and substantially flat and has upper and lower parallel surfaces 82 and 84, respectively. Lifting cylinders 86 and 88 are mounted transversely to the lower surface 84 at either end of frame 80 along the longitudinally extending central axis of frame 80. Lifting cylinders 86 and 88 include pistons 90 and 92 which have support plates 94 and 96 affixed to the lower ends. Support plates 94 and 96 are disposed transversely to the central longitudinal axis of cylinders 86 and 88 and adapted for being placed upon the railroad tie, or other suitable substantially flat surface, so as to support the rail plate and spike extractor assembly.

A carrage M, as best shown in FIG. 5, is connected to the lower surface 84 of frame M. Carriage M is comprised of a two piece displaceable carriage set. The first piece of the two piece carriage set M has a longitudinally extending substantially rectangular member 98 disposed substantially parallel to the central longitudinal axis of frame 80. An upwardly extending member 100 extends transversely to member 98 and is fixedly connected at one end thereof. A downwardly extending member 102 is fixedly connected at the other end of member 98 and is, likewise, substantially transverse to central member 98.

The second piece of the two piece carriage set M is comprised of two opposed members 104 and 106 disposed in a spaced parallel relationship and adapted so that member 98 is disposed there between. Carriage members 104 and 106 are adapted for movement relative to central member 98 by means of opposed spaced parallel tongue members 108 and 110 arrayed on member 98 and adapted for cooperating with grooves 112 and 114 arranged in members 104 and 106, respectively. Consequently, members 98 and 104 and 106 are adapted to permit sliding motion of members 104 and 106 relative to member 98. Grooves 112 and 114 may contain roller bearings or other suitable friction reducing members so as to permit the respective members 104 and 106 to more readily slide relative to member 98.

An upwardly extending substantially rectangular member 116 is affixed to one end of members 104 and 106 and is arrayed in a substantially spaced parallel relationship relative to member 100 such that upwardly extending member 116 opposes upwardly extending member 100. Similarly, a downwardly extending member 118 is disposed substantially transversely to the other end of members 104 and 106 and is arrayed in a spaced parallel relationship relative to member 102 such that downwardly extending member 118 opposes downwardly extending member 102.

Figure 6:
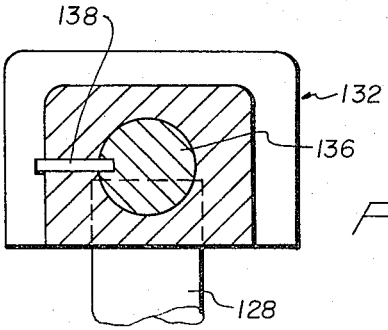
FIG. 6 is a fragmentary cross-sectional view taken along the Section 6—6 of FIG. 5.
Figure 7:
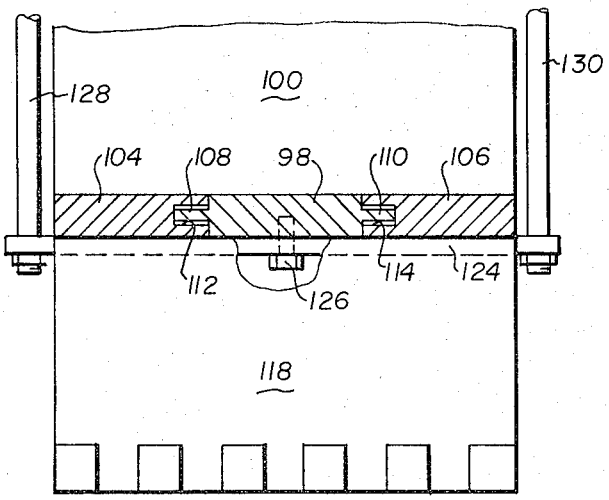
FIG. 7 is a fragmentary left side elevational view with portions broken away taken along the section 7—7 of FIG. 5; and, FIG. 8 is a fragmentary right side elevational view with portions broken away taken along the section 8—8 of FIG. 5.
Figure 8:
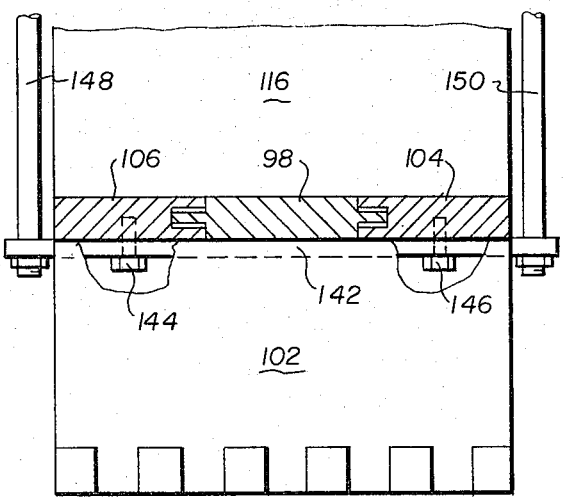

As best shown in FIGS. 5, 7 and 8, carriage M is suspended from frame 80 by means of bracket assemblies 120 and 122. Bracket 122 is comprised of a substantially flat rectangular member 124 extending transversely to member 98 and disposed underneath member 98 for support. Member 124 is bolted by bolt 126 to member 98 so that member 98 is affixed bracket or support plate 124. Support plate 124 is slightly longer than members 100 and 118 and extends a distance beyond on either side thereof. Support bolts 128 and 130 are connected to plate 124 and extend upwardly therefrom. Bolts 128 and 130 are connected to housings 132 and 134 which are substantially identical, and of which one, 132, is best shown in FIG. 6. Housings 132 and 134 contain a threaded aperture for receipt of bolts 128 and 130 and have an aperture disposed perpendicularly therefrom for mounting of axial 136. Axial 136 is keyed by key 138 to housing 132. Wheel 140 is rotatably mounted to axial 136, which connects housings 132 and 134 and is rolling supported on upper surface 82 of frame 80.

Support plate 142, as best shown in FIG. 8, is disposed substantially transversely to members 104 and 106 and is fixedly connected thereby bolts 144 and 146. Member 142 is substantially rectangular and has a length greater than the width of members 116 and 102 and extends a substantial distance on either side thereof. Support bolts 148 and 150 extend upwardly therefrom and are connected to housings 152 and 154, which housings are substantially identical to housing 132 shown in FIG. 6. Axle 156 connects housing 152 and 154 and wheels 158 and 160 are rotatingly mounted thereto and rollingly supported on the upper surface 82 of frame 80. Consequently, carriage M is suspended from frame 80 and is rollingly supported from the upper surface 82 therefrom by means of housing 132, 134, 152 and 154.

Double acting cylinder 162, which is substantially similar to double acting cylinder D is fixedly connected to the lower surface 84 of frame 80 and is disposed substantially parallel to the central longitudinal axis of frame 80 and arranged above member 98. Pistons 164 and 166 extend on either end thereof of cylinder 162. Piston 164 is connected upwardly extending member 100 while piston 166 is connected to upwardly extending member 116. Cylinder 162, as well as cylinders 86 and 88 are operated by hydraulic systems which are well known in the art. Cylinder 162 is arranged so that upon outward movement of pistons 164 and 166, downwardly extending members 102 and 118 approach each other. Likewise, upon inward movement of pistons 164 and 166 downwardly extending members 102 and 118 move away from each other.

Crowbars 168 are arranged at the lower ends of members 102 and 118 and are disposed so as to face each other. Crowbars 168 have a railroad tie contacting portion 170 and an upwardly extending angled portion 172, including an apex there between, for guiding a railroad plate upwardly thereon until stopped by downwardly extending vertical members 102 and 118.

OPERATION

In the embodiment shown in FIGS. 1 through 4, the rail plate and spike puller or extractor assembly is longitudinally positioned on the upper surface of a railroad tie R and has track plate P positioned between opposed crowbars 64, 66, 68 and 70. In the preferred use, the railroad track has previously been removed, but this is not essential to the apparatus or the process.

After the track plate P has been positioned between opposed crowbars 64, 66, 68 and 70 double action cylinder D is initiated by means of the hydraulic unit (not shown) and pistons 56 and 58 move axially outward and displace arms 20 and 22. Arms 20 and 22 pivot on pins 32 and 34 and cause crowbars 64 and 66 and 68 and 70 to move toward each other and to be positioned between plate P and tie R. As best shown in FIG. 3, the axial movement of pistons 56 and 58 causes arms 20 and 22 to move toward the outer longitudinal ends of frame F. This movement causes the opposed crowbars 64, 66, 68 and 70 to move under plate P and displace plate P upwardly therefore. Crowbars 64, 66, 68 and 70 advance under plate P until stopped by holding surfaces 76. Because the spikes S have a head which is larger than the apertures through which they are placed in plate P, upward movement of plate P results in spikes S being displaced upwardly also, as best shown in FIG. 3. After pistons 56 and 58 have travelled a sufficient distance to force plate P into contact with surface 76, lifting cylinders 11 and 13 may be hydraulicly operated by means not shown so as to upwardly displace frame F, as best shown in FIG. 4 by means of pistons 15 and 17. Pistons 15 and 17 are capable of displacing frame F a sufficient distance above railroad tie R so that spikes S are completely extracted and removed from tie R. After spikes S and plate P have been removed from tie R, pistons 56 and 58 may retract and release plate P and spikes S therefore. In this way, an apparatus and a process for integrally removing a track plate and spikes and a railroad tie in a single operation has been described.

In the embodiment shown in FIGS. 5 through 8, the operation of the rail plate and spike puller assembly is essentially similar to that already described. The rail plate and spike puller assembly is longitudinally positioned on support plates 94 and 96 on the upper surface of a railroad tie R such that plate P is positioned between opposed crowbars 172. Double action cylinder 162 is hydraulically powered and pistons 164 and 166 axially extend outwardly and bear against surfaces 100 and 116 and cause member 98 to slide relative to members 104 and 106. Displacement of pistons 164 and 166 causes the crowbars 172 on member 118 and the crowbars 172 on member 102 to approach each other and to be forced and positioned between the track plate P and railroad tie R. The pistons 164 and 166 extend until plate P rests against members 102 and 118. At this point, lifting cylinders 86 and 88 with pistons 90 and 92 may be hydraulically operated to lift frame 80 and thereby remove plate P and spikes S. Because of brackets 120 and 122, and wheels 140, 158 and 160, some of the weight of plate P and spikes S is borne by carriage M. After cylinders 86 and 88 have displaced frame 80 upwardly so that spikes S are completely extracted from railroad tie R, pistons 164 and 166 of cylinder 162 may be axially retracted so as to cause the opposed crowbars 172 to move away from each other and release plate P therefore.

While this invention has been described has having a preferred design, it is understood that it is capable of further modification, uses and/or adaptations of the invention following in general the principles of the inventions and including such departures from the present disclosure as come within known customary practice in the art to which the invention pertains, that as may be applied to the central features hereinbefore set forth and fall within the scope of the invention of the limits of the appended claims.

What I claim is:

1. An apparatus for integrally removing a track plate and spikes secured to a tie, comprising:

(a) three parallel spaced longitudinally extending frame members, each of said frame members having opposed ends;

(b) bracket means secured to generally said frame members ends for fixedly aligning said frame members for defining a frame thereby;

(c) cylinder and piston means secured to said bracket means extending transversely of said frame and including a tie contacting portion and being adapted for reciprocally displacing said frame;

(d) each of said frame members having a pair of spaced apertures and each aperture of a frame member being aligned with an aperture of an adjacent frame member;

(e) a pair of arms pivotally secured to said frame and each of said arms having upwardly and downwardly extending portions, each of said arms including a pair of arm members and having one of said frame members disposed between said arm members;

(f) pin means pivotally securing said arms to said frame;

(g) opposed piston cylinder and piston means pivotally secured to said upwardly extending portion of each of said arms for reciprocally pivoting said arms; and, (h) opposed crowbar means secured to said downwardly extending portion of said arms each of said crowbar means including a tie contacting portion and a track plate contacting portion whereby said track plate contacting portion adapted for being positioned between said track plate and said tie by pivoting of said arms for displacing said track plate and said spikes and whereby said cylinder and piston means upwardly displacing said frame for integrally removing said track plate and said spikes from said frame.

2. An apparatus as defined in claim 1, wherein:

(a) said crowbar means tie contacting portion being generally transverse of an associated arm;

(b) said track plate contacting portion extending angularly upwardly from said tie contacting portion; and, (c) a stop surface generally parallel to said associated arm and extending upwardly from said track plate contacting portion.

3. An apparatus as defined in claim 2, wherein:

(a) at least two of said crowbar means being provided for each of said arms; and, (b) one of said arm members being disposed between said at least two crowbar means of each arm.

4. An apparatus as defined in claim 3, wherein:

(a) a back member secured to said at least two crowbar means.

5. An apparatus as defined in claim 1, further comprising:

(a) lifting means secured to said arms for permitting raising and moving of said apparatus.

6. An apparatus as defined in claim 1, wherein:

(a) said cylinder and piston means tie contacting portion including a plate secured to said cylinder and piston means.

7. An apparatus as defined in claim 1, wherein:

(a) said bracket means including a plate.

8. An apparatus as defined in claim 1, wherein:

(a) said frame members being generally rectangular in cross-section.

9. An apparatus as defined in claim 1, wherein:

(a) said arm members of each arm being parallel and spaced apart.

10. An apparatus as defined in claim 1, wherein:

(a) pin means pivotally securing said opposed piston cylinder and piston means to said arms.

11. An apparatus as defined in claim 1, wherein:

(a) said opposed piston cylinder and piston means including two coaxial opposed pistons adapted for simultaneous outward and inward movement.

12. An apparatus as defined in claim 1, wherein:

(a) said frame members including two outer and an inner member; and (b) said inner member being disposed between said arm members of each of said arms.

13. An apparatus as defined in claim 1, wherein:

(a) said apertures of each of said frame members being coaxial with said apertures of an adjacent frame member.

* * * * *